US008393103B2

(12) United States Patent
Brown

(10) Patent No.: US 8,393,103 B2
(45) Date of Patent: Mar. 12, 2013

(54) FIREARM HAVING A DEBRIS SHIELD

(75) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 542 days.

(21) Appl. No.: 12/496,030

(22) Filed: Jul. 1, 2009

(65) Prior Publication Data

US 2010/0000139 A1 Jan. 7, 2010

Related U.S. Application Data

(60) Provisional application No. 61/133,624, filed on Jul. 1, 2008, provisional application No. 61/211,228, filed on Mar. 27, 2009.

(51) Int. Cl.
*F41A 3/00* (2006.01)

(52) U.S. Cl. ..... 42/16

(58) Field of Classification Search ..... 42/16, 96, 42/106

See application file for complete search history.

(56) References Cited

U.S. PATENT DOCUMENTS

| | | | | |
|---|---|---|---|---|
| 1,379,989 | A | 5/1921 | Johnson | |
| 1,402,459 | A | 1/1922 | Swebilius | |
| 1,413,109 | A * | 4/1922 | Feederle | 42/16 |
| 1,846,993 | A | 2/1932 | Destree | |
| 1,878,038 | A | 9/1932 | Von Frommer | |
| 2,288,202 | A * | 6/1942 | Mossberg | 42/16 |
| 2,341,767 | A | 2/1944 | Gans | |
| 2,462,119 | A | 2/1949 | Moore | |
| 2,685,754 | A | 8/1954 | Crittendon et al. | |
| 2,752,826 | A | 7/1956 | Simpson | |
| 2,775,166 | A | 12/1956 | Janson | |
| 2,780,145 | A | 2/1957 | Saive | |
| 2,783,685 | A | 3/1957 | Green | |
| 2,882,635 | A | 4/1959 | Hill | |
| 2,940,201 | A * | 6/1960 | Reed | 42/16 |
| 2,951,424 | A | 9/1960 | Stoner | |
| 3,176,424 | A | 4/1965 | Hoge | |
| 3,198,076 | A | 8/1965 | Stoner | |
| 3,236,155 | A | 2/1966 | Sturtevant | |
| 3,255,667 | A | 6/1966 | Walther | |
| 3,300,889 | A | 1/1967 | Baker | |
| 3,368,298 | A | 2/1968 | Browning | |
| 3,397,473 | A | 8/1968 | Browning | |
| 3,405,470 | A | 10/1968 | Wesemann | |
| 3,592,101 | A | 7/1971 | Vartanian et al. | |
| 3,618,457 | A | 11/1971 | Miller | |
| 3,619,926 | A | 11/1971 | Alday | |

(Continued)

OTHER PUBLICATIONS

Article entitled "The USA's M4 Carbine Controversy" dated Feb. 2, 2009; www.defenseindustrydaily.com/the-usas-m4-carbine-controversy-03289/.

(Continued)

*Primary Examiner* — Gabriel Klein

(74) *Attorney, Agent, or Firm* — Howard & Howard Attorneys PLLC

(57) ABSTRACT

The present invention provides for a firearm having a receiver defining a bore with the receiver extending along a longitudinal axis. The receiver defines an ejection port transverse to the longitudinal axis with the bore defining an inner surface. The firearm further includes a bolt carrier disposed in the bore and moveable relative to the receiver along the longitudinal axis between a firing position and a rearward position. The firearm also includes a shield longitudinally affixed to the bolt carrier and movable with the bolt carrier as a unit between the firing and rearward positions along the longitudinal axis with the shield blocking the ejection port when in the firing position and the shield sliding along the inner surface away from the ejection port when moving to the rearward position in conjunction with the bolt carrier.

25 Claims, 9 Drawing Sheets

U.S. PATENT DOCUMENTS

| | | | | |
|---|---|---|---|---|
| 3,675,534 | A | 7/1972 | Beretta | |
| 3,686,998 | A | 8/1972 | Seifried | |
| 3,742,636 | A | 7/1973 | Dealy et al. | |
| 3,771,415 | A | 11/1973 | Into et al. | |
| 3,774,498 | A | 11/1973 | Moller et al. | |
| 3,776,095 | A | 12/1973 | Atchisson | |
| 3,938,271 | A | 2/1976 | Hyytinen | |
| 3,938,422 | A | 2/1976 | Tellie | |
| 3,952,440 | A * | 4/1976 | Tellie | 42/106 |
| 3,960,053 | A | 6/1976 | Conley | |
| 3,969,980 | A | 7/1976 | Brandstatter et al. | |
| 3,999,461 | A | 12/1976 | Johnson et al. | |
| 4,020,741 | A | 5/1977 | Junker | |
| 4,044,487 | A | 8/1977 | Hutton et al. | |
| 4,088,057 | A | 5/1978 | Nasypany | |
| 4,125,054 | A | 11/1978 | Jennie | |
| 4,244,273 | A | 1/1981 | Langendorfer, Jr. et al. | |
| 4,246,830 | A | 1/1981 | Krieger | |
| 4,358,986 | A | 11/1982 | Giorgio | |
| 4,389,920 | A | 6/1983 | Dufour, Sr. | |
| 4,398,448 | A | 8/1983 | LaFever | |
| 4,505,182 | A | 3/1985 | Sullivan | |
| 4,553,469 | A | 11/1985 | Atchisson | |
| 4,654,993 | A | 4/1987 | Atchisson | |
| 4,663,875 | A | 5/1987 | Tatro | |
| 4,689,911 | A | 9/1987 | White | |
| 4,693,170 | A | 9/1987 | Atchisson | |
| 4,703,826 | A | 11/1987 | Byron | |
| 4,756,228 | A | 7/1988 | Roth | |
| 4,765,224 | A | 8/1988 | Morris | |
| 4,766,800 | A | 8/1988 | Miller et al. | |
| 4,867,039 | A | 9/1989 | Dobbins | |
| 4,893,547 | A | 1/1990 | Atchisson | |
| 4,972,617 | A | 11/1990 | Major | |
| 5,198,600 | A | 3/1993 | E'Nama | |
| 5,343,650 | A | 9/1994 | Swan | |
| 5,351,598 | A | 10/1994 | Schuetz | |
| 5,540,008 | A | 7/1996 | Kirnstatter | |
| 5,821,445 | A | 10/1998 | Guhring | |
| 5,824,923 | A | 10/1998 | Kondoh et al. | |
| 5,827,992 | A | 10/1998 | Harris et al. | |
| 5,918,401 | A | 7/1999 | Rowlands | |
| 5,945,626 | A | 8/1999 | Robbins | |
| 6,019,024 | A | 2/2000 | Robinson et al. | |
| 6,134,823 | A | 10/2000 | Griffin | |
| 6,311,603 | B1 | 11/2001 | Dunlap | |
| 6,418,655 | B1 | 7/2002 | Kay | |
| 6,453,594 | B1 | 9/2002 | Griffin | |
| 6,481,145 | B2 | 11/2002 | Weichert et al. | |
| 6,499,246 | B1 | 12/2002 | Zedrosser | |
| 6,564,491 | B2 | 5/2003 | Murello | |
| 6,609,321 | B2 | 8/2003 | Faifer | |
| 6,619,592 | B2 | 9/2003 | Vignaroli et al. | |
| 6,625,916 | B1 | 9/2003 | Dionne | |
| 6,634,274 | B1 | 10/2003 | Herring | |
| 6,722,255 | B2 | 4/2004 | Herring | |
| 6,732,466 | B2 | 5/2004 | Bentley | |
| 6,782,791 | B2 | 8/2004 | Moore | |
| 6,829,858 | B2 | 12/2004 | Gablowski | |
| 6,848,351 | B1 | 2/2005 | Davies | |
| 7,000,345 | B1 | 2/2006 | Kay | |
| 7,131,228 | B2 | 11/2006 | Hochstrate et al. | |
| RE39,465 | E | 1/2007 | Swan | |
| 7,181,881 | B2 * | 2/2007 | Fischbach et al. | 42/99 |
| 7,231,861 | B1 | 6/2007 | Gauny et al. | |
| 7,418,898 | B1 | 9/2008 | Desomma | |
| 7,448,307 | B1 | 11/2008 | Dafinov | |
| 7,461,581 | B2 | 12/2008 | Leitner-Wise | |
| 7,469,624 | B1 | 12/2008 | Adams | |
| 7,478,495 | B1 | 1/2009 | Alzamora et al. | |
| 7,819,052 | B2 * | 10/2010 | Zedrosser | 89/199 |
| 2001/0013192 | A1 * | 8/2001 | Murello et al. | 42/75.02 |
| 2003/0074822 | A1 | 4/2003 | Faifer | |
| 2005/0115134 | A1 | 6/2005 | Bond et al. | |
| 2005/0115398 | A1 | 6/2005 | Olson | |
| 2005/0262752 | A1 | 12/2005 | Robinson et al. | |
| 2006/0065112 | A1 | 3/2006 | Kuczynko et al. | |
| 2006/0156606 | A1 | 7/2006 | Robinson et al. | |
| 2006/0236582 | A1 | 10/2006 | Lewis et al. | |
| 2006/0254112 | A1 | 11/2006 | Snoderly | |
| 2007/0033851 | A1 | 2/2007 | Hochstrate et al. | |
| 2007/0199435 | A1 | 8/2007 | Hochstrate et al. | |
| 2008/0110074 | A1 | 5/2008 | Bucholtz et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 * | 2/2009 | Robinson et al. | 42/16 |
| 2010/0000139 | A1 * | 1/2010 | Brown | 42/96 |

OTHER PUBLICATIONS

Article entitled "M4 Carbine Review" dated May 2, 2007; http://home.comcast.net/ shooter2_indy/m4.html.

Article entitled "Critics Turn Crosshairs on Military's Main Rifle" dated Apr. 20, 2008 from the website "USA Today"; www.usatoday.com/news/military/2008-04-20-gunwars_N.htm.

Parts Schematic entitled "Schematic for Bushmaster M4A3 Carbine" from the website "Bushmaster" dated Jun. 2008; www.bushmaster.com/electronic-documents/operation-manual/opmanual.pdf.

Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.

Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

Article entitled "M26 Modular Accessory Shotgun System" from Wikipedia, the free encyclopdia dated Jun. 2008; http://en.wikipedia.org/wiki/M26_Modular_Accessory_Shotgun_System.

Article entitled "M16 rifle" from Wikipedia, the free encyclopedia dated Jun. 2008; http://en.wikipedia.org/wiki/M-16_rifle.

Article entitled "M4 Carbine" from Wikipedia, the free encyclopedia dated Jun. 2008; http://en.wikipedia.org/wiki/M4_carbine.

Animation entitled "How an AR15 Works" from the website dated Jun. 2008; www.barnesengineering.com/AR15animation/index.htm.

* cited by examiner

FIG. 13A
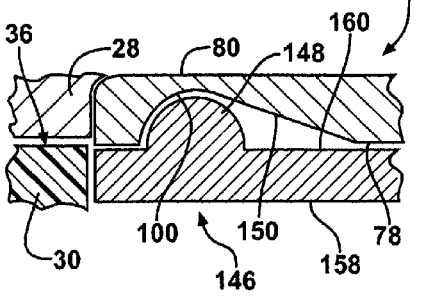
FIG. 13B
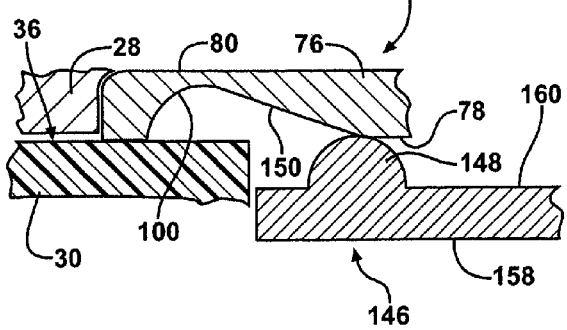
FIG. 14
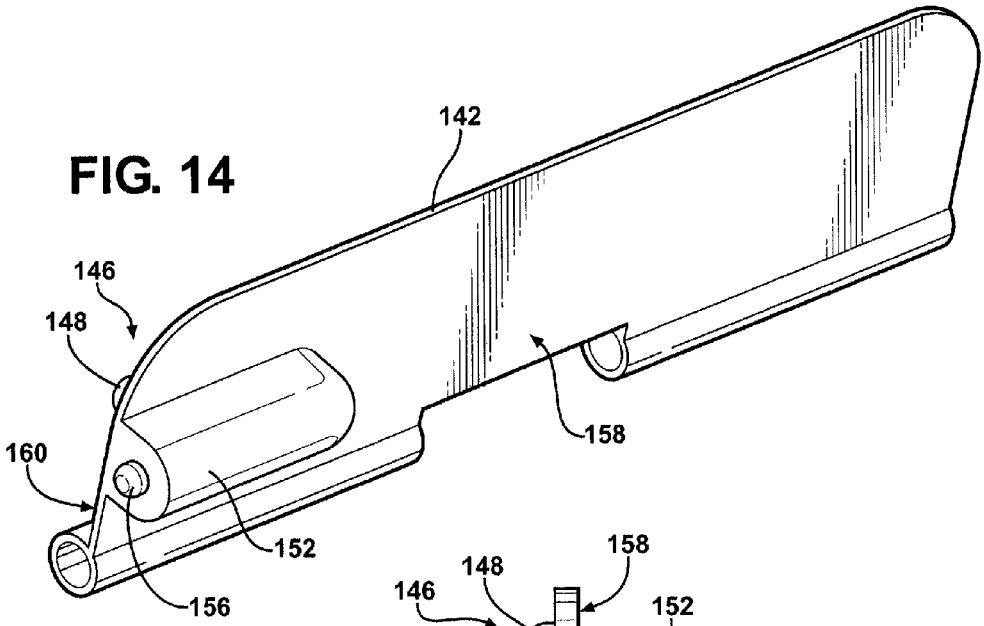
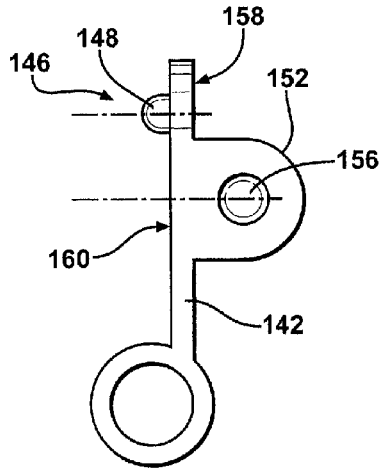
FIG. 15

FIREARM HAVING A DEBRIS SHIELD

CROSS REFERENCE TO RELATED APPLICATIONS

The subject patent application claims priority to and the benefits of U.S. Provisional Patent Application Ser. No. 61/133,624, filed on Jul. 1, 2008 and U.S. Provisional Patent Application Ser. No. 61/211,228, filed on Mar. 27, 2009.

BACKGROUND OF THE INVENTION

1. Field of the Invention

The subject invention relates to firearms and more specifically to mechanisms that minimize fouling of firing components.

2. Description of the Prior Art

Firearms typically include a receiver that houses several working components of the firearm, including firing components, with a barrel extending from the receiver. There are various classes of firearms that operate in different manners. One class of firearm utilizes a bolt carrier is disposed in the receiver that is moveable between a firing position, from which a live round of ammunition can be fired, and a retracted position, from which a spent casing is ejected. The movement of the bolt carrier and ejection of the casing can be accomplished with a direct gas impingement or indirect gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases, including any associated debris, from the barrel, back through a return tube to the bolt carrier, and out the ejection port of the receiver.

Firearms having the indirect gas impingement system do not route the exhaust gases back to the bolt carrier in an effort to reduce fouling caused by the exhaust gases that may occur with direct gas impingement type firearms. Instead, the exhaust gases are used to move a device, such as a piston, that engages the bolt carrier to move the bolt carrier toward the rearward position. However, this type of firearm is still susceptible to fouling of the firing components due to debris entering through the ejection port.

Some firearms include an ejection port door for covering the ejection port to prevent debris from entering the receiver and fouling the firing components. The ejection port door automatically opens in response to firing the firearm and/or charging the firearm, i.e. loading a live round into a chamber of the barrel. However, the ejection port door must be manually moved to the closed position by a user to prevent debris from entering the ejection port and thus entering the receiver. Accordingly, during stressful situations, such as a military situation, it is unlikely the user will consistently close the ejection port door after firing or charging the firearm, thereby allowing debris to foul the firing components and potentially cause the firearm to jam or fail.

The prior art has attempted to solve the problem of debris entering the ejection port. For example, U.S. Pat. No. 3,619,926 to Alday discloses a firearm having a receiver defining an ejection port window with a bolt assembly movably disposed within the receiver. The firearm further includes a cover plate coupled to the bolt assembly with the cover plate movable independently to the bolt assembly. Having the cover plate and the bolt assembly moving independently of each other in such a manner increases frictional wear between the components and thus increases the possibility of the cover plate and/or the bolt assembly failing.

Therefore, there remains a need to develop a firearm having a mechanism that automatically blocks an ejection port when in a firing position and minimizes, if not eliminates, fouling of the firing components.

SUMMARY OF THE INVENTION AND ADVANTAGES

The present invention provides for a firearm having a receiver defining a bore with the receiver extending along a longitudinal axis. The receiver defines an ejection port transverse to the longitudinal axis with the bore defining an inner surface. The firearm further includes a bolt carrier disposed in the bore and moveable relative to the receiver along the longitudinal axis between a firing position and a rearward position. The firearm also includes a shield longitudinally affixed to the bolt carrier and movable with the bolt carrier as a unit between the firing and rearward positions along the longitudinal axis with the shield blocking the ejection port when in the firing position and the shield sliding along the inner surface away from the ejection port when moving to the rearward position in conjunction with the bolt carrier.

The present invention further provides for a breech block mechanism for the firearm including the bolt carrier defining a hole extending along a bolt axis and moveable between an initial position and a mid position. The mechanism further includes a bolt disposed in the hole and movable along the bolt axis between a first position and a second position during movement of the bolt carrier between the initial and mid positions. The mechanism also includes the shield longitudinally affixed to the bolt carrier and moving with the bolt carrier as a unit along the bolt axis during movement between the initial and mid positions while the bolt moves between the first and second positions.

In addition, the present invention provides for a shield apparatus coupled to the bolt carrier. The shield apparatus includes a body having a middle portion, a first end portion defining a first recess and a second end portion defining a second recess. The first and second end portions extend outwardly from the middle portion away from each other. A first spring is mounted in the first recess and a second spring is mounted in the second recess for biasing the body away from the bolt carrier.

Additionally, the present invention provides for an ejection system for the firearm having the receiver defining the bore along the longitudinal axis and the ejection port transverse to the longitudinal axis. The system further includes the bolt carrier disposed in the bore and moveable relative to the receiver along the longitudinal axis between the firing position and the rearward position. A door is coupled to the receiver adjacent the ejection port with the door movable between a closed position covering the ejection port and a released position allowing the door to move away from the ejection port. The shield is coupled to the bolt carrier and movable with the bolt carrier between the firing and rearward positions with the shield blocking the ejection port when in the firing position and the shield spaced from the ejection port when in the rearward position. The system also includes a release mechanism having a first portion coupled to the shield and a second portion coupled to the door with the first portion engaging the second portion as the shield moves from the firing position to the rearward position for moving the door from the closed position to the released position.

Accordingly, the present invention defines a mechanism, in the form of a shield or a shield apparatus that minimizes, if not eliminates, fouling of the firing components, i.e. the action. In particular, the shield is longitudinally affixed to a bolt carrier to provide automatic blocking of an ejection port anytime the bolt carrier is in a firing position without having to manually close a door for preventing debris from entering the ejection port and fouling the firing components. In addition, the shield is longitudinally affixed to the bolt carrier and movable with the bolt carrier as a unit along a longitudinal axis for reducing frictional wear between the shield and the bolt carrier.

BRIEF DESCRIPTION OF THE DRAWINGS

Other advantages of the present invention will be readily appreciated, as the same becomes better understood by reference to the following detailed description when considered in connection with the accompanying drawings.

FIG. 13A is a fragmented cross-sectional view of a door in a closed position with a protrusion disposed within a dimple of the shield.

FIG. 13B is a fragmented cross-sectional view of the door in a released position with the protrusion engaging a ramped surface of the dimple.

FIG. 14 a perspective view of the door.

FIG. 15 is an end view of the door.

DETAILED DESCRIPTION OF THE INVENTION

Figure 1:
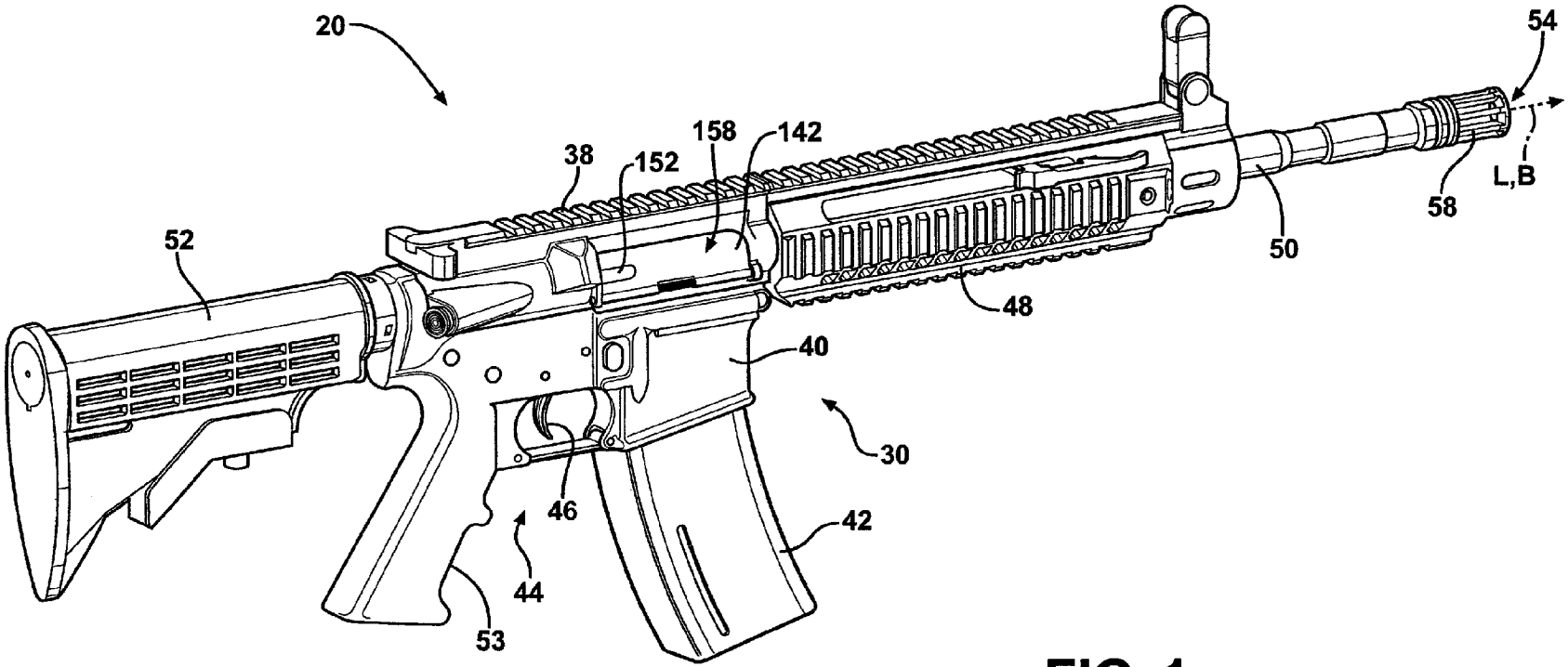
FIG. 1 is a perspective view of a firearm in accordance with the subject invention.

Referring to the Figures, wherein like numerals indicate like or corresponding parts throughout the several views, a firearm 20 is generally shown in FIG. 1. Also referring to FIGS. 2, 3A and 3B, the firearm 20 receives and fires a live round 22 of ammunition (hereinafter "live round"), also referred to as a cartridge, which includes a casing 24, a bullet 26, and other components to propel the bullet 26 as known to those skilled in the art.

The firearm 20 can be of a certain class of firearms 20 that utilize a direct gas impingement system or an indirect gas impingement system to eject a spent casing 24 after firing the firearm 20. Examples of such types of firearms 20 include the M16, the M4®, such as the M4® carbine, and the AR-15®, such as the AR-15® Platform. However, it should be appreciated that the firearm 20 can be of any type without departing from the nature of the present invention. The firearm 20 described herein is designed to permit easy retro-fitting of the components to a variety of currently and/or previously manufactured firearm designs including direct gas impingement systems and indirect gas impingement systems. The indirect gas impingement system utilizes a piston assembly (not shown) for moving a bolt carrier 28, as further disclosed and claimed in U.S. patent application Ser. No. 12/496,000 filed concurrently with the present application, which is incorporated herein by reference.

The firearm 20 includes a receiver 30 defining a bore 32 extending along a longitudinal axis L and houses several working components of the firearm 20, such as the firing components, i.e. the action. The bore 32 of the receiver 30 will be referred to as a first bore 32 throughout this description. As used herein, the phrase "along the longitudinal axis" includes components and/or movements aligning with the longitudinal axis L and/or spaced from and substantially parallel to the longitudinal axis L. The receiver 30 defines an ejection port 34 transverse to the longitudinal axis L with the first bore 32 defining an inner surface 36. As known in the art, the receiver 30 is often divided into an upper receiver portion 38 and a lower receiver portion 40 attached to the upper receiver portion 38. The upper receiver portion 38 defines the first bore 32 and the ejection port 34.

A magazine 42, also referred to as a clip, is detachably mounted to the lower receiver portion 40 and can be loaded with a plurality of live rounds 22. The firearm 20 further includes a trigger assembly 44 supported by the receiver 30. The trigger assembly 44 includes a trigger 46 and a hammer (not shown). The trigger 46 is pulled to move the hammer, which, as discussed further below, ultimately results in the firing of the firearm 20.

The firearm 20 includes a hand guard 48 that extends from the receiver 30 circumferentially about a barrel 50 such that a user can hold the hand guard 48 of the firearm 20. Details of the hand guard 48 are further disclosed and claimed in U.S. patent application Ser. No. 12/496,003 filed concurrently with the present application, which is incorporated herein by reference. A buttstock 52 extends rearwardly from the receiver 30 for supporting the firearm 20 against a shoulder of the user. A hand grip 53 extends downwardly along the lower receiver portion 40 for gripping by the user.

The barrel 50 is coupled to the receiver 30 and defines a second bore 54 extending along the longitudinal axis L. The details of how the barrel 50 is coupled to the receiver 30 is further disclosed and claimed in U.S. patent application Ser. No. 12/496,003 filed concurrently with the present application, which is incorporated herein by reference. The barrel 50 includes a breech 56 adjacent the receiver 30 and a muzzle 58 spaced from the breech 56 along the longitudinal axis L with the breech 56 defining a chamber 60 extending along the longitudinal axis L for receiving one of the live rounds 22. The live rounds 22 are individually loaded into the chamber 60 from the magazine 42. The chamber 60 aligns with the second bore 54 such that the bullet 26 moves out of the chamber 60 and the second bore 54 when firing the firearm 20.

The bolt carrier 28 is disposed in the first bore 32. The bolt carrier 28 is moveable relative to the receiver 30 along the longitudinal axis L between a firing position and a rearward position. Specifically, a bolt 62 and a firing pin 64 are carried by the bolt carrier 28. The bolt carrier 28 typically has features for automatically releasing another live round 22 from the magazine 42 into the chamber 60 as the bolt carrier 28 moves toward the firing position. As the bolt carrier 28 moves from the rearward position toward the firing position, the bolt carrier 28 catches or pushes another live round 22 into the chamber 60 of the barrel 50. In the firing position, the bolt 62 locks to the breech 56 of the barrel 50 to hold the live round 22 in the chamber 60. The firing components can include the bolt carrier 28, the bolt, the firing pin 64, the trigger 46, the hammer and other components as known to those skilled in the art.

When the bolt carrier 28 is in the firing position, the trigger 46 can be pulled to release the hammer, which strikes the firing pin 64. When the hammer strikes the firing pin 64, the firing pin 64 strikes the live round 22 to fire the live round 22, which causes the bullet 26 to move through and out of the second bore 54. After firing the live round 22, the bolt carrier 28 moves by gas impingement toward the rearward position and the casing 24, which is now empty, is expelled from the receiver 30 through the ejection port 34. The bolt carrier 28 automatically moves toward the firing position thereby automatically loading another live round 22 from the magazine 42 into the chamber 60.

Although the firearm 20 shown in the Figures is of the semi-automatic type or the automatic type, it is appreciated that the firearm 20 can also be a single-shot firearm 20 without departing from the nature of the present invention. A semi-automatic firearm 20 is one that fires a single live round 22 when the trigger 46 is pulled and thereafter automatically loads another live round 22. An automatic firearm 20 is one that individually fires multiple live rounds 22 with a single pull of the trigger 46 and continues to load and fire live rounds 22 until the trigger 46 is released. A single-shot firearm 20 requires manual loading of each live round 22 and fires a single live round 22 when the trigger 46 is pulled.

Figure 3A:
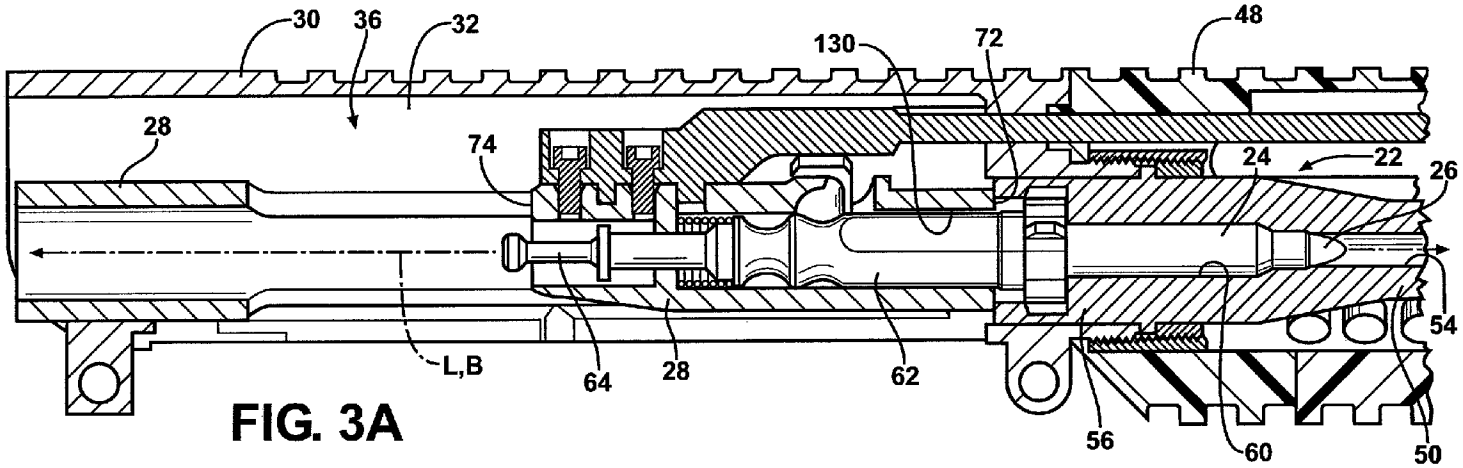
FIG. 3A is a fragmented partial cross-sectional view of the firearm with a bolt carrier in an initial position and a bolt in a first position.
Figure 4:
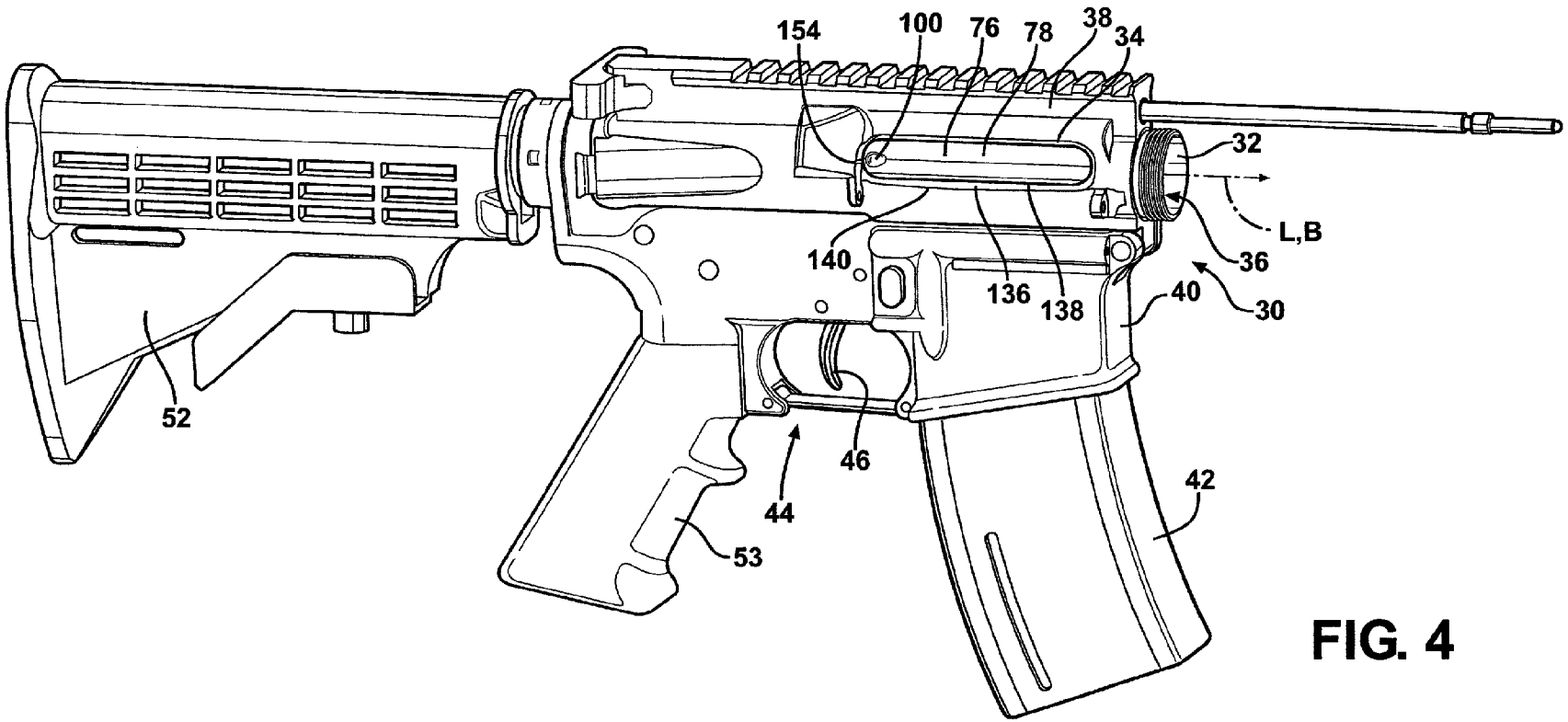
FIG. 4 is a perspective view of the firearm with certain components removed and the bolt carrier in a firing position.
Figure 5:
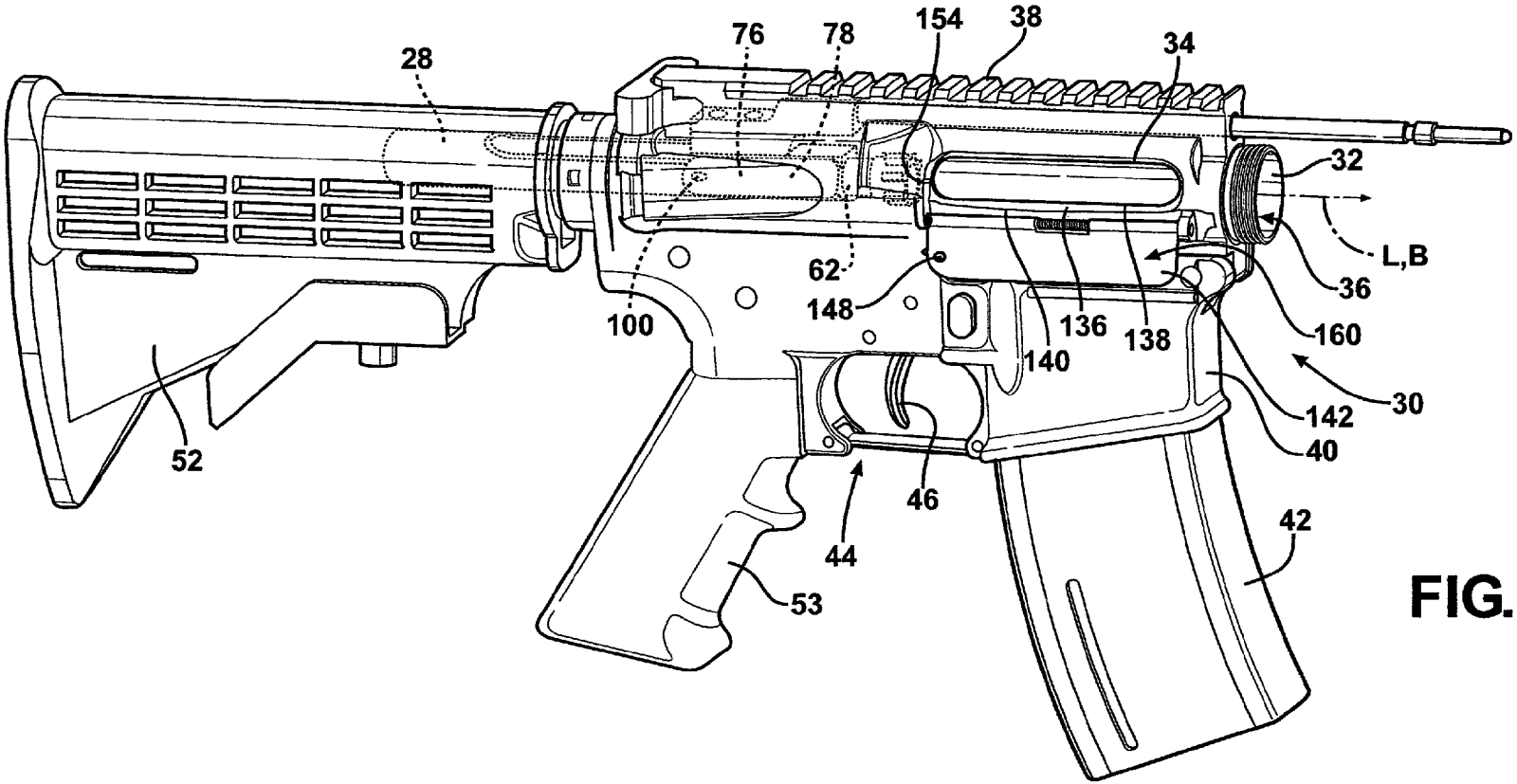
FIG. 5 is a perspective view of the firearm with certain components removed and the bolt carrier in a rearward position.

The firearm 20 includes the bolt carrier 28 disposed in the first bore 32 and moveable relative to the receiver 30 along the longitudinal axis L between the firing position and the rearward position. The firing position is shown in FIGS. 3A and 4 and the rearward position is shown in FIG. 5, which will both be discussed further below. Also referring to FIGS. 6 and 7, the bolt carrier 28 defines a bolt carrier recess 66 having an outer surface 68 with the outer surface 68 including a distal rim 70 extending angularly away from the longitudinal axis L. The distal rim 70 extends partially around the outer surface 68 of the bolt carrier recess 66. More specifically, the bolt carrier 28 includes a first end 72 and a second end 74 spaced from each other with the bolt carrier recess 66 abutting the first end 72 and the distal rim 70 extending away from the first end 72 along the longitudinal axis L.

The firearm 20 further includes a shield 76 longitudinally affixed to the bolt carrier 28 and moving with the bolt carrier 28 as a unit between the firing and rearward positions along the longitudinal axis L. In other words, the shield 76 and the bolt carrier 28 fail to move independently of each other along the longitudinal axis L which reduces frictional wear between the bolt carrier 28 and the shield 76. The concurrent movement of the bolt carrier 28 and the shield 76 also ensures proper positioning and operation of the shield 76. The bolt carrier 28 and the shield 76 are removable from the first bore 32 of the receiver 30 as the unit for providing easy cleaning and/or replacement of the components of the firearm 20. More specifically, the bolt carrier 28 and the shield 76 are inserted into the first bore 32 of the receiver 30 as the unit during assembly of the firearm 20 and the bolt carrier 28 and the shield 76 are removed from the first bore 32 of the receiver 30 as the unit during disassembly of the firearm 20. For example, the bolt carrier 28 and the shield 76 as described herein is easily retro-fitted into existing firearms by merely removing the existing bolt carrier.

The shield 76 is formed of a self lubricating polymeric material and more specifically formed of a thermoplastic material, such as an acetal polymer. Other suitable plastics include nylon 12, such as Lauramid® and Nyaltron®; polyoxymethylene; phenolic composites; or combinations thereof. Preferably, the self lubricating polymeric material is formed of Delrin® AF, which comprises an acetal homopolymer having a polytetrafluoroethylene filler, e.g. PTFE fibers. It is to be appreciated that other polymeric materials can also be used to form the shield 76.

Figure 7:
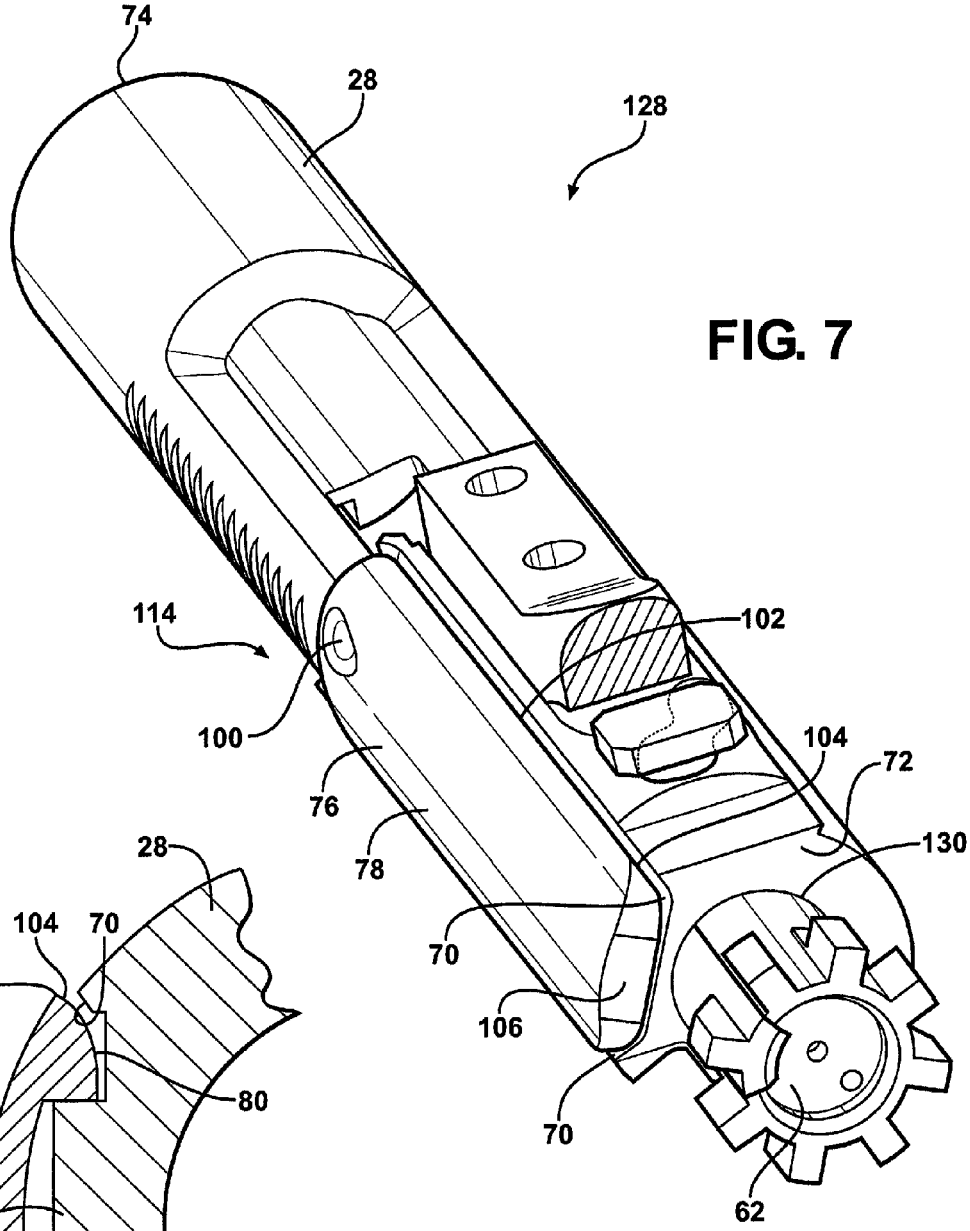
FIG. 7 is a perspective view of the bolt carrier and the shield.
Figure 8:
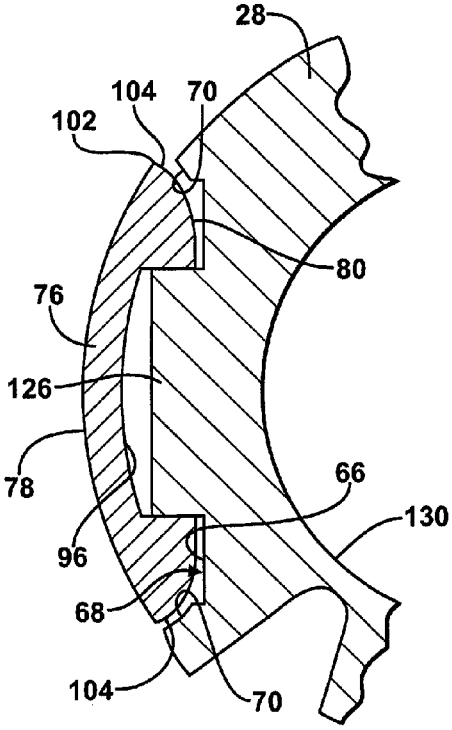
FIG. 8 is a fragmented cross-sectional view of the bolt carrier and the shield taken through a boss of the bolt carrier and a fifth recess of the shield.
Figure 9:
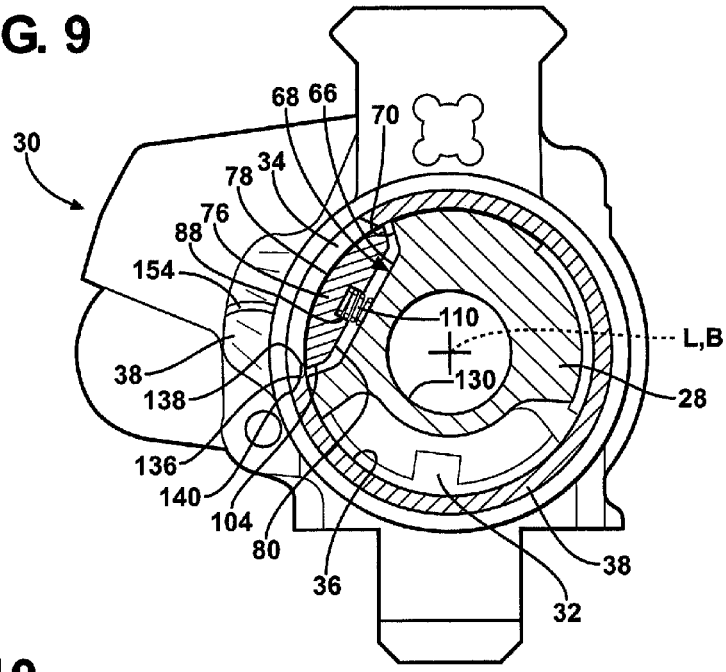
FIG. 9 is a cross-sectional view of the receiver, the bolt carrier and a bolt illustrating the shield being biased outwardly into engagement with the receiver.

Referring to FIGS. 7-9, the shield 76 includes an exterior side 78 and an interior side 80 spaced from each other and more specifically, the shield 76 is further defined as a body. The interior side 80 of the shield 76 faces the outer surface 68 of the bolt carrier recess 66 and the exterior side 78 of the shield 76 faces the inner surface 36 of the receiver 30. The bolt carrier 28 defines the bolt carrier recess 66 for receiving the shield 76.

Figure 10:
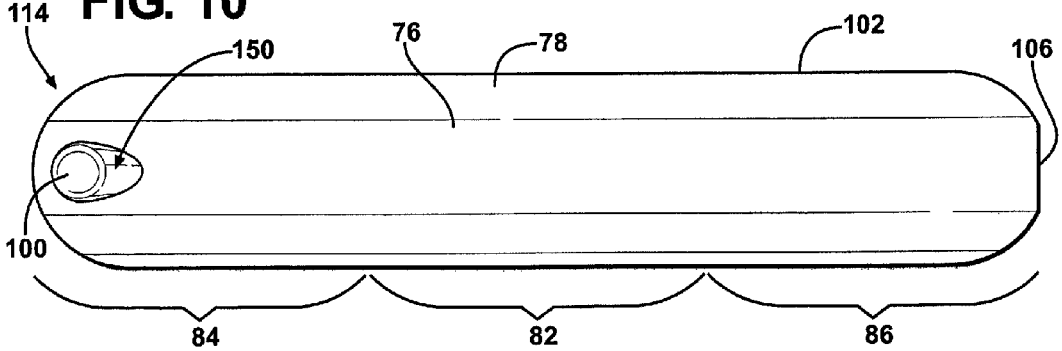
FIG. 10 is a plan view of an exterior side of the shield.
Figure 11:
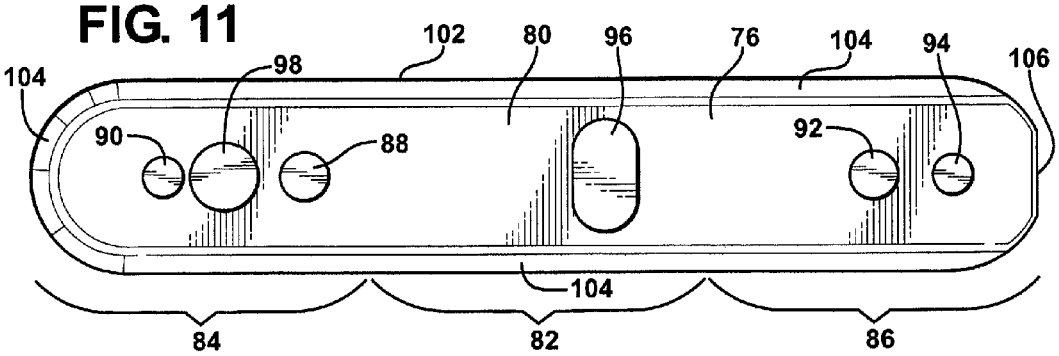
FIG. 11 is a plan view of an interior side of the shield.

Also referring to FIGS. 10 and 11, the shield 76 further includes a middle portion 82, a first end portion 84 and a second end portion 86. The first and second end portions 84, 86 extend outwardly from the middle portion 82 away from each other. In other words, the middle portion 82 is disposed between the first and second end portions 84, 86.

The first end portion 84 defines a first recess 88 and a third recess 90 spaced from each other and the second end portion 86 defines a second recess 92 and a fourth recess 94 spaced from each other. The middle portion 82 defines a fifth recess 96 and more specifically, the fifth recess 96 is spaced between the first and second recesses 88, 92. The first end portion 84 further defines a sixth recess 98 spaced between the first and third recesses 88, 90 and a dimple 100 disposed in an opposing relationship to the first, third and sixth recesses 88, 90, 98. In other words, the dimple 100 is disposed on the exterior side 78 and the first, third and sixth recesses 88, 90, 98 are disposed on the interior side 80. More specifically, the first, second, third, fourth, fifth and sixth recesses 88, 92, 90, 94, 96, 98 are disposed on the interior side 80 of the body. The first, second, third, fourth, fifth and sixth recesses 88, 92, 90, 94, 96, 98 and the dimple 100 will be discussed further below.

The shield 76 further includes an outer edge 102 and an angled portion 104 tapering toward the outer edge 102 along a part of the shield 76 with the distal rim 70 of the outer surface 68 and the angled portion 104 being complementary in configuration to each other. More specifically, the angled portion 104 is disposed on the interior side 80. The angled portion 104 tapers toward the outer edge 102 along the middle portion 82 and the first end portion 84 with the angled portion 104 tapering toward the outer edge 102 along a part of the second end portion 86. In other words, the outer edge 102 includes a flat end 106 along the second end portion 86 with the flat end 106 terminating at the angled portion 104. The flat end 106 of the shield 76 is complementary with the first end 72 of the bolt carrier 28 for preventing the shield 76 from interfering with the operation of the bolt carrier 28 or any other interference with other components of the firearm 20.

Figure 6:
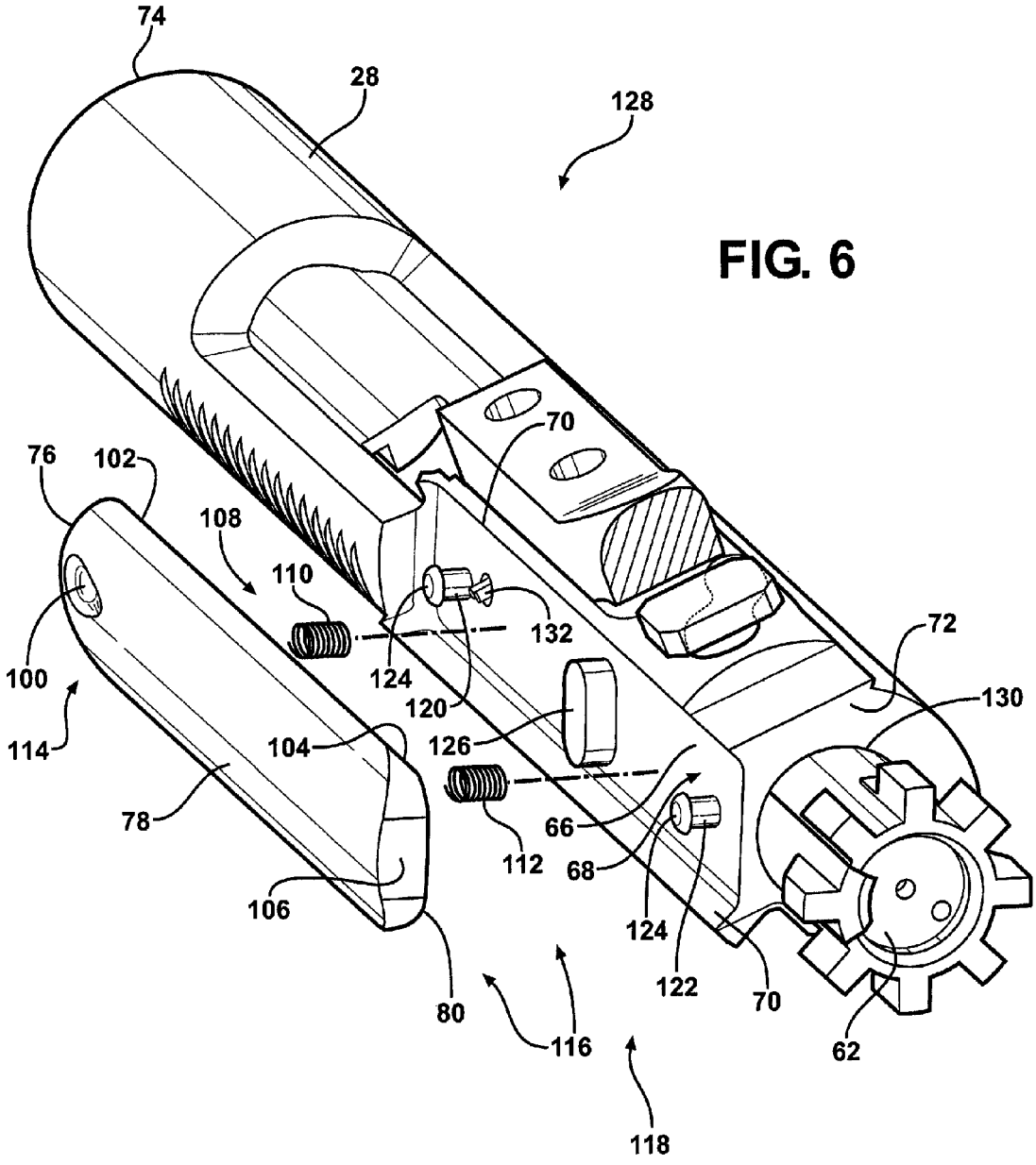
FIG. 6 is an exploded perspective view of the bolt carrier and a shield.

As best shown in FIGS. 6 and 9, the firearm 20 also includes a biasing device 108 disposed between the bolt carrier 28 and the shield 76 for biasing the shield 76 outwardly away from the bolt carrier 28 such that the shield 76 continuously engages the inner surface 36 of the receiver 30 during movement in the firing and rearward positions. The biasing device 108 preferably includes a first spring 110 and a second spring 112 spaced from each other and disposed between the bolt carrier 28 and the shield 76 for biasing the first and second end portions 84, 86 outwardly away from the bolt carrier 28 transverse to the longitudinal axis L. More specifically, the first spring 110 is mounted in the first recess 88 of the first end portion 84 and the second spring 112 is mounted in the second recess 92 of the second end portion 86 for biasing the body away from the bolt carrier 28. The interior side 80 of the shield 76 can abut the outer surface 68 of the bolt carrier 28 or can be spaced from the outer surface 68 as long as the exterior side 78 remains in engagement with the inner surface 36 of the receiver 30. As used herein, the body and the first and second springs 110, 112 define a shield apparatus 116 which is coupled to the bolt carrier 28.

The firearm 20 further includes a securing system 118 attached to one of the bolt carrier 28 and the shield 76 for longitudinally affixing the shield 76 to the bolt carrier 28. In other words, the securing system 118 prevents the shield 76 from moving independently of the bolt carrier 28 along the longitudinal axis L while permitting the shield 76 to move independently of the bolt carrier 28 transverse to the longitudinal axis L. The securing system 118 can be of any suitable design and preferably includes a first peg 120 and a second peg 122 spaced from each other and more specifically, the first and second pegs 120, 122 extend outwardly from the outer surface 68 of the bolt carrier recess 66 for longitudinally affixing the shield 76 to the bolt carrier 28. Each of the first and second pegs 120, 122 include a lip 124 for engaging the shield 76 to longitudinally affix the shield 76 to the bolt carrier 28. More specifically, the lip 124 of the first peg 120 frictionally engages the third recess 90 of the first end portion 84 and the lip 124 of the second peg 122 frictionally engages the fourth recess 94 of the second end portion 86 for longitudinally affixing the shield 76 to the bolt carrier 28 while allowing tilting and/or biasing movement of the shield 76. In other words, the shield 76 is longitudinally affixed to the bolt carrier 28 in such a manner as to allow the shield 76 to move closer to and farther away from the outer surface 68 during biasing movement while also allow tilting movement of the shield 76 relative to the bolt carrier 28.

The securing system 118 further preferably includes a boss 126 extending outwardly from the outer surface 68 between the first and second pegs 120, 122 with the boss 126 disposed in the fifth recess 96 of the middle portion 82 for longitudinally affixing the shield 76 to the bolt carrier 28. The boss 126 and the shield 76 can be modified for the direct gas impingement system with the boss 126 defining at least one exhaust port (not shown) and the shield 76 defining an aperture (not shown) aligning with the exhaust port for exhausting gases therethrough, as further disclosed and claimed in U.S. patent application Ser. No. 12/496,011 filed concurrently with the present application, which is incorporated herein by reference.

When the shield 76 is removed from the first and second pegs 120, 122 of the bolt carrier 28, the first and second springs 110, 112 remain fixed within the first and second recesses 88, 92. In other words, the first and second springs 110, 112 are integrated into the first and second recesses 88, 92 of the shield 76 by a friction fit or any other acceptable method, such as fasteners, welding, adhesive etc. Alternatively, the first and second springs 110, 112 can be integrated into the bolt carrier 28 without deviating from the scope of the invention.

As best shown in FIG. 4, the shield 76 blocks the ejection port 34 when in the firing position and the shield 76 slides along the inner surface 36 away from the ejection port 34 when moving to the rearward position in conjunction with the bolt carrier 28. Having the shield 76 longitudinally affixed to the bolt carrier 28 provides automatic blocking of the ejection port 34 anytime the bolt carrier 28 is in the firing position without having to manually close the ejection port 34 for preventing debris from entering the ejection port 34 and fouling the firing components. The shield 76 is sized slightly larger than the ejection port 34 for continuously blocking the ejection port 34 when in the firing position to prevent debris from entering the receiver 30 and the chamber 60, and thus prevent fouling of the firing components. More specifically, the exterior side 78 of the shield 76 is in continuous engagement with the inner surface 36 of the receiver 30 during any movement of the bolt carrier 28.

Referring to FIGS. 3A and 4, the firing position is defined as when the bolt carrier 28 abuts the breech 56 of the barrel 50 with or without a live round 22 disposed in the chamber 60 of the barrel 50. Referring to FIG. 5, the rearward position is defined as when the bolt carrier 28 moves away from the breech 56 of the barrel 50. More specifically, the rearward position is further defined as when the bolt carrier 28 is spaced from the breech 56 of the barrel 50 after ejecting a spent casing 24 and prior to catching another live round 22 to reload into the chamber 60. In other words, the firing position is further defined as the middle portion 82 and the first and second end portions 84, 86 of the shield 76 completely blocking the ejection port 34 such that the bolt carrier 28 abuts the breech 56 with or without a live round 22 disposed in the chamber 60 and the rearward position is further defined as the middle portion 82 and the first and second end portions 84, 86 of the shield 76 being completely spaced from the ejection port 34 within the receiver 30 after ejecting a spent casing 24 and prior to catching another live round 22 to reload into the chamber 60.

Figure 3B:
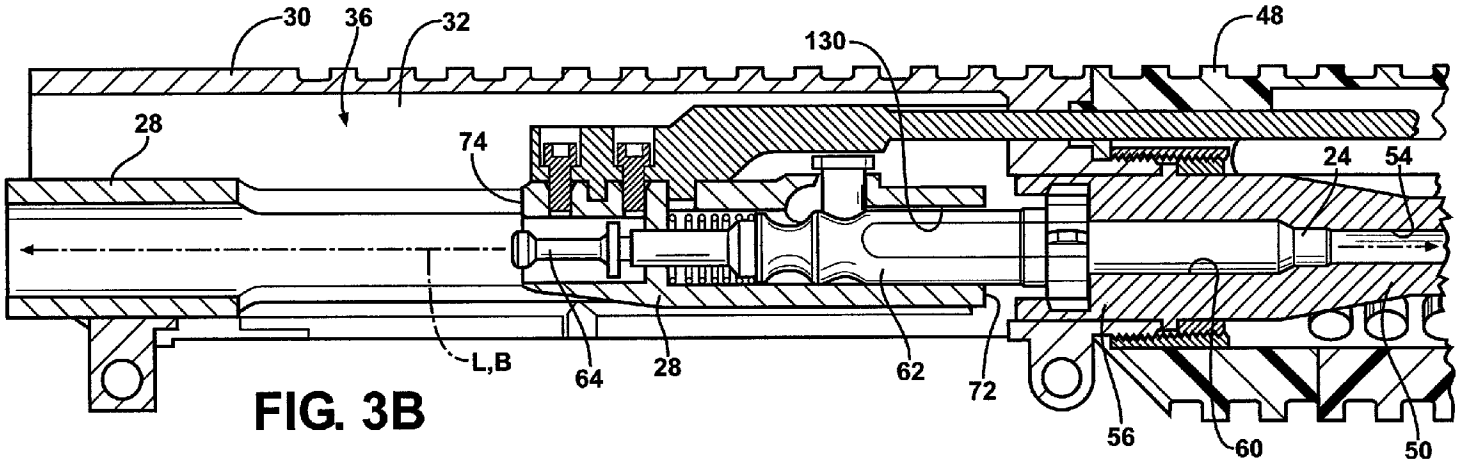
FIG. 3B is a fragmented partial cross-sectional view of the firearm with the bolt carrier in a mid position and the bolt in a second position.

As best shown in FIGS. 3A and 3B, the bolt carrier 28, the shield 76 and the bolt 62 define a breech block mechanism 128. The bolt carrier 28 also defines a hole 130 extending along a bolt axis B and moveable between an initial position and a mid position. The initial position of the bolt carrier 28 is shown in FIG. 3A and is defined as the firing position as discussed above. The mid position of the bolt carrier 28 is shown in FIG. 3B and is defined as being between the initial/firing positions and the rearward position. More specifically, the mid position is defined as when the bolt carrier 28 is spaced from the breech 56 of the barrel 50 but prior to ejecting the spent casing 24.

As used herein, the phrase "along the bolt axis" includes components and/or movements aligning with the bolt axis B and/or spaced from and substantially parallel to the bolt axis B. Specifically, the bolt axis B is substantially parallel to the longitudinal axis L. More specifically, the bolt axis B aligns with the longitudinal axis L.

The bolt 62 is disposed in the hole 130 and movable along the bolt axis B between a first position and a second position during movement of the bolt carrier 28 between the initial and mid positions. The first position of the bolt 62 is shown in FIG. 3A and is defined as when the bolt 62 is locked into the breech 56 of the barrel 50 prior to firing the firearm 20. Thus, when the bolt carrier 28 is in the initial/firing position, the bolt 62 is in the first position, which occurs prior to firing the firearm 20. The second position of the bolt 62 is shown in FIG. 3B and is defined as when the bolt 62 rotates about the bolt axis B and unlocks from the breech 56 of the barrel 50 after firing the firearm 20 thus allowing the bolt carrier 28 and the bolt 62 to move toward the rearward position. Therefore, when the bolt carrier 28 in the mid position, the bolt 62 is in the second position, which occurs after firing the firearm 20. As the bolt 62 moves from the first position to the second position, the bolt 62 rotates to unlock the bolt 62 from the breech 56 of the barrel 50 for allowing the bolt carrier 28 and the bolt 62 to continue to move to the rearward position.

The shield 76 is longitudinally affixed to the bolt carrier 28 and moves with the bolt carrier 28 as the unit along the bolt axis B during movement between the initial and mid positions while the bolt 62 moves between the first and second positions. For additional disclosure of the bolt 62 and the firing sequence, refer to U.S. patent application Ser. No. 12/496,000 filed concurrently with the present application, which is incorporated herein by reference. The bolt carrier 28, the shield 76 and the bolt 62 as described herein is easily retrofitted into existing firearms 20 by merely removing the existing bolt carrier.

The breech block mechanism 128 further includes the biasing device 108 disposed between the bolt carrier 28 and the shield 76 for biasing the shield 76 outwardly away from the bolt carrier 28. The breech block mechanism 128 also includes a pin 132 disposed through the bolt carrier 28 and the hole 130 transverse to the bolt axis B for coupling the bolt 62 to the bolt carrier 28. The pin 132 extends slightly beyond the outer surface 68 of the bolt carrier recess 66 with the sixth recess 98 of the shield 76 aligning with the pin 132 such that the pin 132 fails to interfere with tilting and/or biasing movement of the shield 76.

Figures 2, 12:
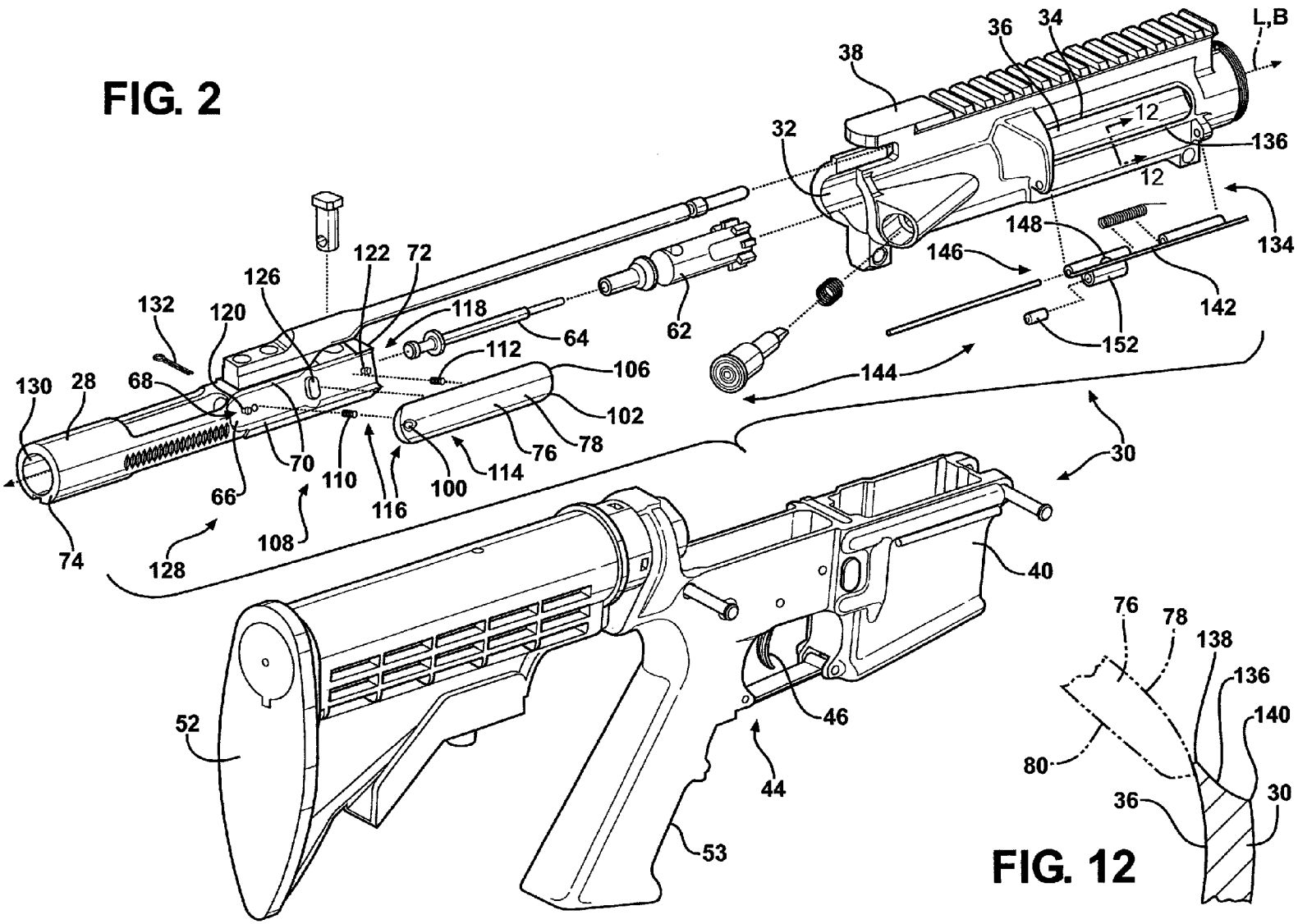
FIG. 2 is an exploded perspective view of a breech block mechanism, a receiver and a buttstock.
FIG. 12 is a fragmented cross-sectional view of the receiver having a slanted portion taken from lines 12-12 of FIG. 2 with a shield shown in phantom.

Referring to FIG. 2, an ejection system 134 having the receiver 30 and the bolt carrier 28 as discussed above is generally shown. Turning to FIGS. 9 and 12, the receiver 30 also includes a slanted portion 136 having a top edge 138 abutting the ejection port 34 and a bottom edge 140 spaced from the ejection port 34. The slanted portion 136 angles outwardly away from the longitudinal axis L as the slanted portion 136 extends from the top edge 138 toward the bottom edge 140. The ejection system 134 includes the shield 76 coupled to the bolt carrier 28 and movable with the bolt carrier 28 between the firing and rearward positions with the shield 76 blocking the ejection port 34 when in the firing position and the shield 76 spaced from the ejection port 34 when in the rearward position.

The ejection system 134 further includes a door 142 coupled to the receiver 30 adjacent the ejection port 34. The door 142 is movable between a closed position covering the ejection port 34, a released position allowing the door 142 to move away from the ejection port 34 and an open position completely spaced from the ejection port 34. The closed position is shown in FIGS. 1 and 13A, the released position is shown in FIG. 13B and the open position is shown in FIG. 5. For illustrative purposes, the door 142 is removed from the receiver 30 in FIG. 4.

As best shown in FIG. 2, the ejection system 134 also includes a release mechanism 144 having a first portion 114 coupled to the shield 76 and a second portion 146 coupled to the door 142. The first portion 114 engages the second portion 146 as the shield 76 moves from the firing position to the rearward position for moving the door 142 from the closed position to the released position. More specifically, the first portion 114 is further defined as the dimple 100 for receiving the second portion 146 and the second portion 146 is further defined as a protrusion 148. Preferably, the first portion 114 or dimple 100 is integrally formed in the shield 76. More preferably, the first portion 114 or dimple 100 is recessed from the exterior side 78 of the shield 76. Alternatively, the first portion 114 can be attached to the shield 76 by adhesive or any other suitable method, such as welding, fasteners etc. As used herein, the firearm 20 also includes the door 142 and the release mechanism 144.

The dimple 100 includes a ramped surface 150 for engaging the second portion 146 as the shield 76 moves from the firing position to the rearward position. Referring to FIG. 13A, the protrusion 148 is disposed in the dimple 100 when the door 142 is in the closed position. Referring to FIG. 13B, the protrusion 148 engages the ramped surface 150 when the shield 76 moves from the firing position toward the rearward position for moving the door 142 to the released position. The door 142 is spring biased such that once the door 142 is in the released position, the door 142 will automatically rotate downwardly to the open position to fully open the ejection port 34 as shown in FIG. 5.

Referring to FIGS. 14 and 15, the door 142 further includes a latch 152 spaced from the protrusion 148 and selectively engages the receiver 30 for maintaining the door 142 in the closed position prior to the shield 76 moving from the firing position toward the rearward position. More specifically, as shown in FIG. 9, the receiver 30 defines an arcuate groove 154 aligning with the latch 152 for guiding the latch 152 when the door 142 moves from the closed position to the released position. Once the door 142 is opened, the door 142 remains open until the user rotates the door 142 back to the closed position and the latch 152 engages the receiver 30.

The latch 152 includes a ball 156 and a spring (not shown) attached to each other such that the spring continuously biases the ball 156 into engagement with the arcuate groove 154 when the door 142 is in the closed position. The latch 152 and the protrusion 148 are offset from each other such that the latch 152 and the protrusion 148 are in different planes and more specifically, the ball 156 and the protrusion 148 are in different planes. The door 142 includes an exterior surface 158 facing away from the ejection port 34 and an interior surface 160 facing the ejection port 34 with the latch 152 attached to the exterior surface 158 and the protrusion 148 attached to the interior surface 160.

Obviously, many modifications and variations of the present invention are possible in light of the above teachings. The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A firearm comprising:

a receiver defining a bore with said receiver extending along a longitudinal axis and said receiver defining an ejection port transverse to said longitudinal axis with said bore defining an inner surface;

a bolt carrier disposed in said bore and moveable relative to said receiver along said longitudinal axis between a firing position and a rearward position; and a shield longitudinally affixed to said bolt carrier and moving with said bolt carrier as a unit between said firing and rearward positions along said longitudinal axis, said shield being immovable relative to said bolt carrier along said longitudinal axis, and said shield blocking said ejection port when in said firing position and said shield sliding along said inner surface away from said ejection port when moving to said rearward position in conjunction with said bolt carrier.

2. A firearm as set forth in claim 1 further including a biasing device disposed between said bolt carrier and said shield for biasing said shield outwardly away from said bolt carrier.

3. A firearm as set forth in claim 2 wherein said shield includes a middle portion, a first end portion and a second end portion with said first and second end portions extending outwardly from said middle portion away from each other such that said middle portion and said first and second end portions completely block said ejection port when in said firing position and said middle portion and said first and second end portions are completely spaced from said ejection port within said receiver when in said rearward position and wherein said biasing device includes a first spring and a second spring spaced from each other and disposed between said bolt carrier and said shield for biasing said first and second end portions outwardly away from said bolt carrier transverse to said longitudinal axis.

4. A firearm as set forth in claim 3 wherein said first end portion defines a first recess for mounting said first spring therein and said second end portion defines a second recess for mounting said second spring therein.

5. A firearm as set forth in claim 1 wherein said bolt carrier defines a bolt carrier recess having an outer surface for receiving said shield.

6. A firearm as set forth in claim 5 wherein said outer surface includes a distal rim extending angularly away from said longitudinal axis.

7. A firearm as set forth in claim 6 wherein said shield includes an outer edge and an angled portion tapering toward said outer edge along a part of said shield with said distal rim and said angled portion being complementary in configuration to each other.

8. A firearm as set forth in claim 5 further including a securing system attached to one of said bolt carrier and said shield for longitudinally affixing said shield to said bolt carrier.

9. A firearm as set forth in claim 8 wherein said securing system includes a first peg and a second peg spaced from each other with said first and second pegs extending outwardly from said outer surface for longitudinally affixing said shield to said bolt carrier.

10. A firearm as set forth in claim 9 wherein each of said first and second pegs include a lip for engaging said shield to longitudinally affix said shield to said bolt carrier.

11. A firearm as set forth in claim 10 wherein said shield includes a middle portion, a first end portion and a second end portion with said first and second end portions extending outwardly from said middle portion away from each other such that said middle portion and said first and second end portions are completely blocking said ejection port when in said firing position and said middle portion and said first and second end portions are completely spaced from said ejection port within said receiver when in said rearward position and wherein said first end portion defines a third recess and said second end portion defines a fourth recess with said lip of said first peg frictionally engaging said third recess and said lip of said second peg frictionally engaging said fourth recess for longitudinally affixing said shield to said bolt carrier while allowing tilting movement of said shield.

12. A firearm as set forth in claim 11 wherein said securing system includes a boss extending outwardly from said outer surface between said first and second pegs.

13. A firearm as set forth in claim 12 wherein said middle portion defines a fifth recess for receiving said boss to longitudinally affix said shield to said bolt carrier.

14. A firearm as set forth in claim 6 wherein said bolt carrier includes a first end and a second end spaced from each other with said bolt carrier recess abutting said first end and said distal rim extending away from said first end along said longitudinal axis.

15. A firearm as set forth in claim 1 further including a door coupled to said receiver adjacent said ejection port with said door movable between a closed position covering said ejection port and a released position allowing said door to move away from said ejection port.

16. A firearm as set forth in claim 15 further including a release mechanism having a first portion coupled to said shield and a second portion coupled to said door with said first portion engaging said second portion as said shield moves from said firing position to said rearward position for moving said door from said closed position to said released position.

17. A firearm as set forth in claim 1 wherein said bolt carrier and said shield are removable from said bore of said receiver as said unit.

18. An ejection system for a firearm, said system comprising:

a receiver defining a bore with said receiver extending along a longitudinal axis and said receiver defining an ejection port transverse to said longitudinal axis;

a bolt carrier disposed in said bore and moveable relative to said receiver along said longitudinal axis between a firing position and a rearward position;

a door coupled to said receiver adjacent said ejection port with said door movable between a closed position covering said ejection port and a released position allowing said door to move away from said ejection port;

a shield coupled to said bolt carrier and movable with said bolt carrier between said firing and rearward positions with said shield blocking said ejection port when in said firing position and said shield spaced from said ejection port when in said rearward position; and a release mechanism having a first portion coupled to said shield and a second portion coupled to said door with said first portion engaging said second portion as said shield moves from said firing position to said rearward position for moving said door from said closed position to said released position.

19. A system as set forth in claim 18 wherein said first portion is further defined as a dimple for receiving said second portion.

20. A system as set forth in claim 19 wherein said dimple includes a ramped surface for engaging said second portion as said shield moves from said firing position to said rearward position.

21. A system as set forth in claim 20 wherein said second portion is further defined as a protrusion disposed in said dimple when said door is in said closed position and engaging said ramped surface when said shield moves from said firing position toward said rearward position for moving said door to said released position.

22. A system as set forth in claim 21 wherein said door includes a latch spaced from said protrusion and selectively engaging said receiver for maintaining said door in said closed position prior to said shield moving from said firing position toward said rearward position.

23. A system as set forth in claim 22 wherein said receiver defines an arcuate groove aligning with said latch for guiding said latch when said door moves from said closed position to said released position.

24. A system as set forth in claim 22 wherein said door includes an exterior surface facing away from said ejection port and an interior surface facing said ejection port with said latch attached to said exterior surface and said protrusion attached to said interior surface.

25. A system as set forth in claim 18 wherein said receiver includes a slanted portion having a top edge abutting said ejection port and a bottom edge spaced from said ejection port with said slanted portion angling outwardly away from said longitudinal axis as said slanted portion extends from said top edge toward said bottom edge.

* * * * *